US006613985B2

(12) United States Patent
Irie et al.

(10) Patent No.: US 6,613,985 B2
(45) Date of Patent: Sep. 2, 2003

(54) SUSPENSION INSULATOR

(75) Inventors: Takashi Irie, Nagoya (JP); Masahiro Akizuki, Nagoya (JP); Shigeru Ogawa, Nagoya (JP); Kenji Sato, Nagoya (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/940,231

(22) Filed: Aug. 28, 2001

(65) Prior Publication Data

US 2002/0060089 A1 May 23, 2002

(30) Foreign Application Priority Data

Aug. 28, 2000 (JP) ..... 2000-257294
Jul. 11, 2001 (JP) ..... 2001-211068

(51) Int. Cl.[7] ..... H01B 17/02; H01B 17/42
(52) U.S. Cl. ..... 174/140 C; 174/182; 174/194
(58) Field of Search ..... 174/137 A, 140 C, 174/141 C, 179, 180, 182, 194, 211, 140 H, 140 R, 141 R

(56) References Cited

U.S. PATENT DOCUMENTS 1,284,976 A * 11/1918 Austin ..... 174/182
1,702,236 A * 2/1929 Austin ..... 174/140 R
1,868,479 A * 7/1932 Austin ..... 174/182
1,994,266 A * 3/1935 Austin ..... 174/182
2,154,387 A * 4/1939 Sleeman ..... 174/140 C
2,275,208 A * 3/1942 Taylor ..... 174/140 C
2,443,436 A * 6/1948 Taylor ..... 174/182
3,243,505 A * 3/1966 Clark ..... 174/140 C
3,658,583 A * 4/1972 Ogawa et al. ..... 174/140 C
3,798,351 A * 3/1974 Tsuzuki et al. ..... 174/140 C
4,103,103 A * 7/1978 Hizikata ..... 106/717
4,343,966 A * 8/1982 Pargamin ..... 174/140 S
4,443,659 A * 4/1984 Tatem ..... 174/140 C
4,782,199 A * 11/1988 Seike et al. ..... 174/182
4,792,647 A * 12/1988 Watanabe et al. ..... 174/182
5,796,048 A * 8/1998 Suzuki et al. ..... 174/137 A

* cited by examiner

*Primary Examiner*—Dean A. Reichard
*Assistant Examiner*—Adolfo Nino
(74) *Attorney, Agent, or Firm*—Parkhurst & Wendel, L.L.P.

(57) ABSTRACT

A suspension insulator having a shed including an upper surface and an under surface has a pin fitting arranged at its center portion and projected from the under surface and a plurality of circular ribs arranged around the pin fitting in a concentric manner. In a first aspect of the invention, a resistance zone having a surface resistance (1 cm×1 cm) of not greater than 4 MΩ and arranged on the under surface at an inner portion continuing from the pin fitting and a conductive zone arranged on the under surface at an outer peripheral portion of the resistance zone. In a second aspect of the invention, a resistance zone arranged on the under surface at an inner portion continuing from the pin fitting and existing between the pin fitting and an inner root portion of the rib.

11 Claims, 14 Drawing Sheets

(2 of 14 Drawing Sheet(s) Filed in Color)

Creepage distance at high temperature portion

35mm

Surface temperature distribution of known suspension insulator in pollution wet state Creepage distance at high temperature portion 60mm Surface temperature distribution of suspension insulator according to invention in pollution wet state

SUSPENSION INSULATOR

BACKGROUND OF THE INVENTION

1. Field of the Invention

The present invention relates to a suspension insulator for high voltage transmission, which improves pollution withstand voltage characteristics.

2. Description of Related Art

In the suspension insulator, if a salt component in seawater carried by wind and weather or a salt component in an exhaust gas from a factory is adhered to a surface of the suspension insulator and the suspension insulator becomes a wet state due to such a salt component, an insulation resistance of a surface of the suspension insulator is decreased. In this case, there is a drawback such that a flashover may occur due to reduction of pollution withstand voltage characteristics. Therefore, in the case of performing an insulation design of power transmission equipment, it is very important to take the pollution withstand voltage characteristics of the suspension insulator into consideration.

Generally, it is known that the pollution withstand voltage characteristics can be improved by designing a longer creepage distance of the suspension insulator. Therefore, in the known suspension insulator, a method for designing a longer creepage distance by making a diameter of shed of the suspension insulator larger or by increasing the number of ribs arranged on an under surface of the suspension insulator or a depth between the ribs is adopted. However, in the method mentioned above, there is a drawback such that a dimension of the suspension insulator becomes necessarily larger.

Moreover, except for a geometrical shape design mentioned above, there is known a method such that the pollution withstand voltage characteristics are recovered by arranging a conductive glaze on a surface of the insulator so as to flow a weak current thereon and by drying wet pollution substances adhered to the surface of the insulator by means of a heating effect due to the weak current. Further, a method for improving the pollution withstand voltage characteristics is also actually utilized wherein an electric field relaxation is performed by relaxing a potential inclination along the surface of the insulator and a discharge due to a partly and rapidly deviating electric field. This method mentioned above is very effective, but there arises a deterioration such that a surface of the conductive glaze is sometimes eroded by an environmental pollution or such that a surface resistance is sometimes increased.

In order to solve the drawbacks mentioned above, the present applicant proposed a suspension insulator, in Japanese Patent Application No. 11-369186, such that a circular electrode is arranged on an under surface, to which a glaze is arranged, axially with respect to a pin fitting, or, such that a resistance zone having an electric resistance of 1–100 MΩ (corresponding to a surface resistance of 4.3–430 MΩ) is arranged on the circular electrode and on a portion between the circular electrode and the pin fitting. The suspension insulator mentioned above shows a sufficient performance for the pollution withstand voltage characteristics that are necessary at that time. However, the suspension insulator mentioned above sometimes shows a poor performance for higher pollution withstand voltage characteristics and a higher discharge suppress performance that are recently required. Therefore, a suspension insulator having higher pollution withstand voltage characteristics and a higher discharge suppress performance is required.

SUMMARY OF THE INVENTION

An object of the present invention is to eliminate the drawbacks mentioned above and to provide a suspension insulator which can respectively perform an improvement of pollution withstand voltage characteristics and a prevention of a discharge and which can improve a voltage distribution along an insulator string.

According to a first aspect of the invention, a suspension insulator having a shed including an upper surface and an under surface comprises: a pin fitting arranged at its center portion and projected from the under surface; a plurality of circular ribs arranged around the pin fitting in a concentric manner; a resistance zone having a surface resistance (1 cm×1 cm) of not greater than 4Ω and arranged on the under surface at an inner portion continuing from the pin fitting; and a conductive zone arranged on the under surface at an outer peripheral portion of the resistance zone.

Moreover, according to a second aspect of the invention, a suspension insulator having a shed including an upper surface and an under surface comprises: a pin fitting arranged at its center portion and projected from the under surface; a plurality of circular ribs arranged around the pin fitting in a concentric manner; and a resistance zone arranged on the under surface at an inner portion continuing from the pin fitting and existing between the pin fitting and an inner root portion of the rib.

As mentioned above, since the resistance zone having a predetermined resistance and the conductive zone are arranged in the first aspect of the invention, or, since the resistance zone is arranged at a predetermined position in the second aspect of the invention, a position to which a high electric power is concentrated can be moved outward with respect to the center of insulator, and thus it is possible to form a stable dry zone with a low power. As a result, it is also possible to improve a voltage distribution along the insulator string and thus it is also possible improve pollution withstand voltage characteristics and to prevent a discharge. In the present invention, a term "a portion between the pin fitting and an inner root portion of the rib" means a portion between the pin fitting and a bottom of the target circular rib that is near to the pin fitting among a plurality of circular ribs.

As a preferred embodiment of the invention, both in the first aspect of the invention in which the resistance zone and the conductive zone are arranged and in the second aspect of the invention in which the resistance zone is arranged at a predetermined position, the following embodiments are preferred since the effects of the invention can be further improved: a material of the resistance zone is a conductive glaze of ferric oxide series or a conductive glaze of tin oxide series; and a resistance zone as is the same as the resistance zone arranged on the under surface at an inner portion continuing from a cap fitting arranged on a head portion of the suspension insulator is arranged on an upper surface thereof, and a conductive zone as is the same as the conductive zone arranged on the under surface is arranged on the upper surface at an outer peripheral portion of the resistance zone. Moreover, in the first aspect of the invention, the following embodiments are preferred since the effects of the invention can be further improved: the conductive zone has a half or less surface resistance as compared with that of the resistance zone; the resistance zone is arranged at a portion between the pin fitting and an inner root portion of the rib; a material of the conductive zone is a metal, a conductive glaze of ferric oxide series having a low resistance or a conductive glaze of tin oxide series having a low resistance, and a thickness of the glaze of the conductive zone is larger than that of the glaze of the resistance zone; and the conductive zone, whose thickness is larger than that of the resistance zone, is formed by arranging a recess to the under surface at a portion to which the conductive zone is formed, and filling a conductive material such as the conductive glaze of ferric oxide series or tin oxide series in the thus formed recess. Furthermore, in the second aspect of the invention, the following embodiment is preferred since the effects of the invention can be improved: the resistance zone has a surface resistance (1 cm×1 cm) of not greater than 4MΩ.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DESCRIPTION OF THE PREFERRED EMBODIMENT

Figure 1A:
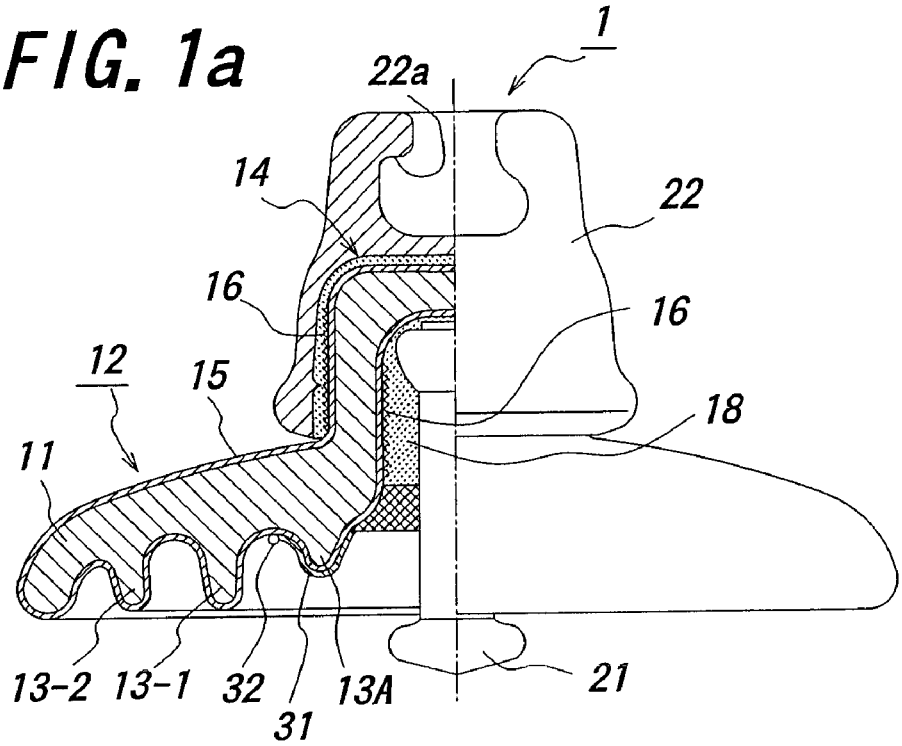
FIGS. 1*a* and 1*b* are schematic views respectively showing one embodiment of a suspension insulator according to the first aspect of the invention.
Figure 1B:
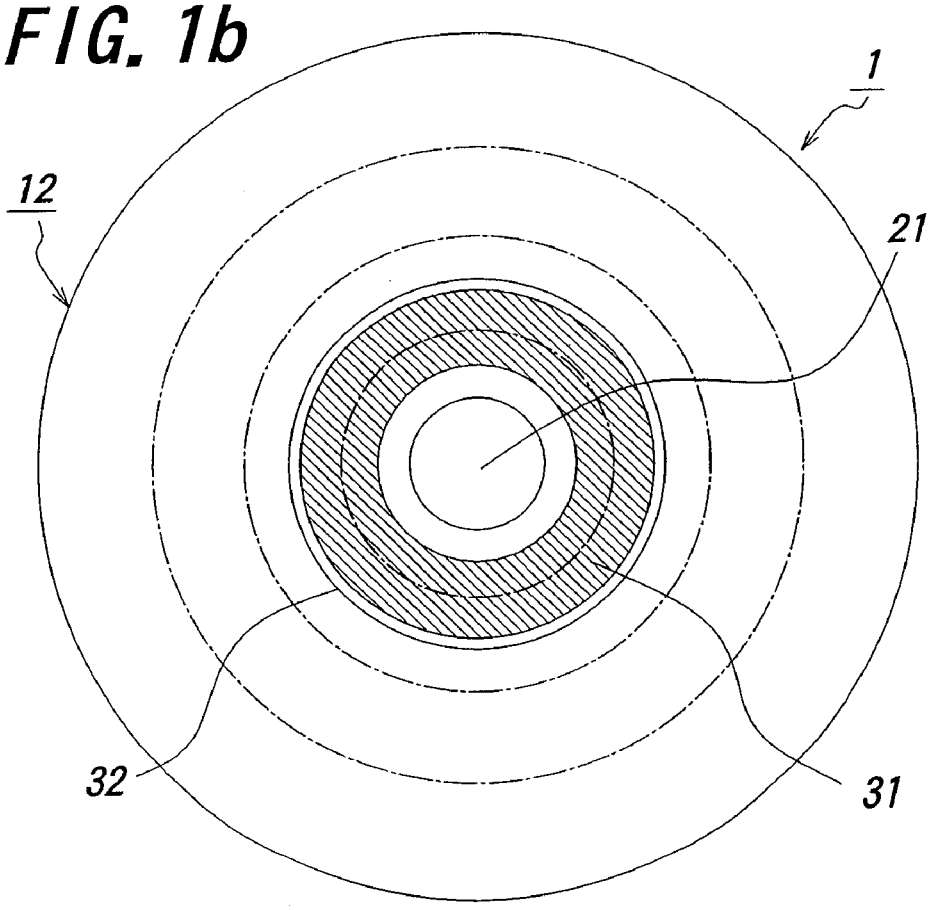

FIGS. 1*a* and 1*b* are schematic views respectively showing one embodiment of a suspension insulator according to the first aspect of the invention. FIG. 1*a* shows a partial cross sectional view that is viewed from a front side, and FIG. 1*b* illustrates a schematic view that is viewed from an under side. In FIGS. 1*a* and 1*b*, a suspension insulator 1 according to the invention has a construction mentioned below. A number of concentric circular ribs 13 are integrally formed to an inner under surface of a shed portion 12 of an insulator body 11. Here, a first circular rib 13-1 and a second circular rib 13-2 are arranged from a near side of a pin fitting 21. In this embodiment, a projection portion 13A that is nearest to the pin fitting 21 is not the circular rib, but a so-called circular hump. A hollow head portion 14 is integrally formed at a center upper portion of the shed portion 12. A generally known insulation glaze is arranged on an overall surface of the insulator body 11 so as to form an insulation glaze zone 15 as an insulation surface.

Sand zones 16 are respectively arranged on an outer side surface and an inner side surface of the head portion 14. A cap fitting 22 of a ground side and the pin fitting 21 of a power supply side are respectively fixed to an outer surface and an inner surface of the head portion 14 of the insulation body 11 via Portland cement. Therefore, the cap fitting 22 and the pin fitting 21 are positioned at both ends of the insulator body 11 respectively. A depression portion 22*a* for fastening the pin fitting 21 of the other suspension insulator 1 arranged just above is formed in an upper portion of the cap fitting 22. An under portion of the pin fitting 21 is fastened to the depression portion 22*a* of the other suspension insulator 1 arranged just beneath. In this manner, a number of the suspension insulators 1 according to the invention are connected with each other in series, and this state is called as a string.

Features of the first aspect of the suspension insulator 1 according to the invention lie in the constructions such that a resistance zone 31 having a surface resistance (1 cm×1 cm) of not greater than 4 MΩ is arranged on an under surface at an inner portion continuing from the pin fitting 21 and such that a circular conductive zone 32 is arranged on the under surface at an outer peripheral portion of the resistance zone 31. In this case, it is preferred that the circular conductive zone 32 has a half or less surface resistance as compared with that of the resistance zone 31. Moreover, it is preferred that a material of the conductive zone 32 is a metal, a conductive glaze of ferric oxide series having a low resistance or a conductive glaze of tin oxide series having a low resistance, and a thickness of the glaze of the conductive zone is larger than that of the glaze of the resistance zone 31. Further, it is preferred that the resistance zone 31 is arranged at a portion between the pin fitting 21 and the inner root portion of the first circular rib 13-1 or between the pin fitting 21 and an inner root portion of the second circular rib 13-2. In the embodiment shown in FIG. 1, the resistance zone 31 is arranged from the pin fitting 21 to the inner root portion of the first circular rib 13-1. Furthermore, it is preferred that a material of the resistance zone 31 is a conductive glaze of ferric oxide series or a conductive glaze of thin oxide series.

Moreover, it is preferred that a resistance zone as is the same as the resistance zone 31 arranged on the under surface at an inner portion continuing from the cap fitting 22 arranged on the head portion 14 of the suspension insulator 1 is arranged on an upper surface of the suspension insulator 1, and a conductive zone as is the same as the conductive zone 32 arranged on the under surface is arranged on the upper surface at an outer peripheral portion of the resistance zone 31.

Figure 16A:
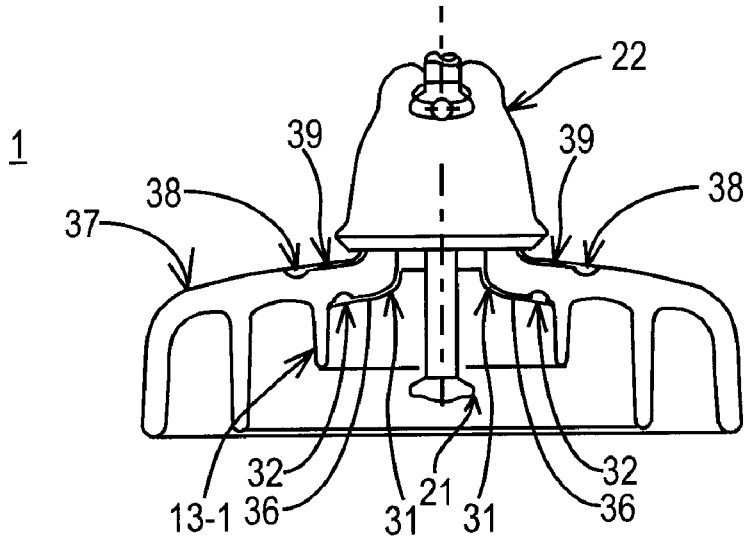
FIGS. 16*a* and 16*b* are schematic views respectively showing another embodiment of the suspension insulator shown in FIGS. 1*a* and 1*b*.

Referring to FIG. 16*a*, it is preferred that a circular resistance zone 31 and a circular conductive zone 32 are located on the under surface 36 between the inner root portion of the first circular rib 13-1 and the pin fitting 21, the circular conductive zone 32 being radially outward of the resistance zone 31, a circular resistance zone 39, the same as the resistance zone 31, and a circular conductive zone 38, the same as the conductive zone 32, are located on the upper surface 37, the conductive zone 38 being radially outward of the resistance zone 39.

Figure 16B:
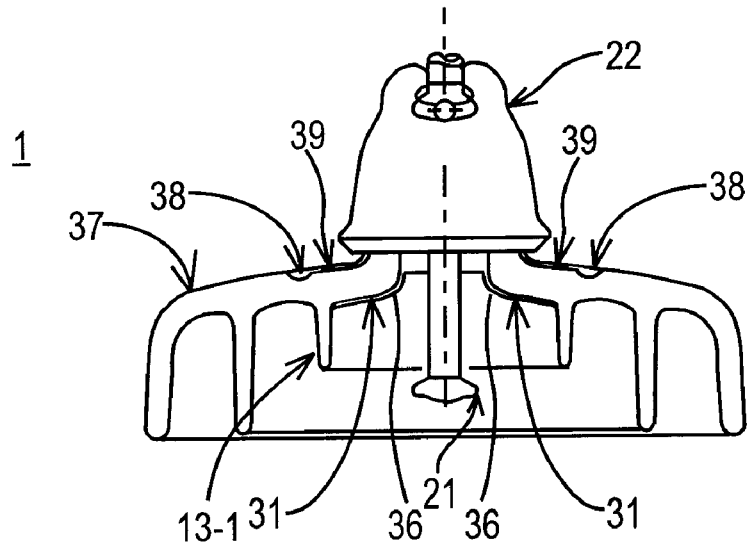

Referring to FIG. 16*b*, it is preferred that a circular resistance zone 31 is located on the under surface 36 between the inner root portion of the first circular rib 13-1 and the pin fitting 21, and a circular resistance zone 39, the same as the resistance zone 31, and a circular conductive zone 38, the same as the conductive zone 32, are located on the upper surface 37, the conductive zone 38 being radially outward of the resistance zone 39.

Figure 2:
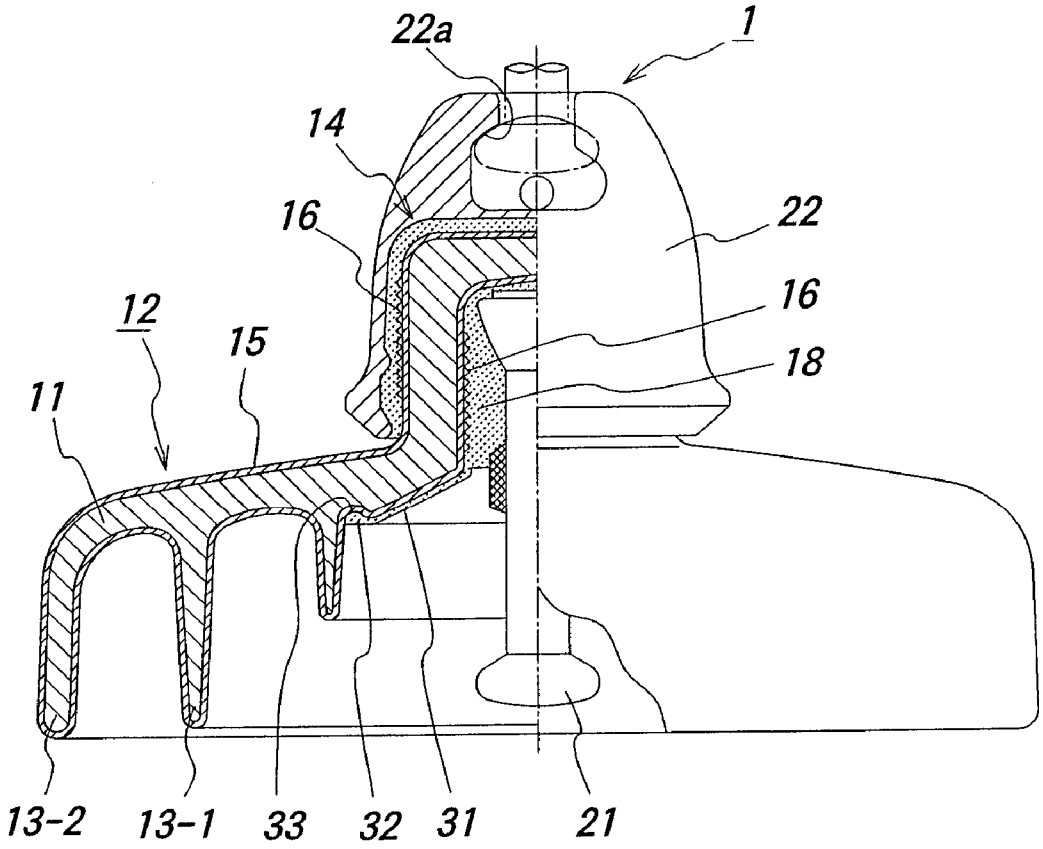
FIG. 2 is a partial cross sectional view illustrating another embodiment of the suspension insulator according to the first aspect of the invention.

FIG. 2 is a partial cross sectional view showing another embodiment of the suspension insulator according to the first aspect of the invention. In the embodiment shown in FIG. 2, portions similar to those of FIGS. 1*a* and 1*b* are denoted by the same reference numerals as those of FIGS. 1*a* and 1*b*, and the explanations thereof are omitted here. In the embodiment shown in FIG. 2, features different from the embodiment shown in FIGS. 1*a* and 1*b* are that the conductive zone 32, whose glaze thickness is larger than that of the resistance zone 31, is formed by arranging a recess 33 having a circular cross section to the under surface of the insulator body 11 at a portion to which the circular conductive zone 32 is formed, and filling a conductive material constructing the conductive zone 32 such as the conductive glaze of ferric oxide series or tin oxide series in the thus formed recess 33. Moreover, a shape of the suspension insulator 1 is different from the embodiment shown in FIGS. 1*a* and 1*b*, and the suspension insulator 1 shown in FIG. 2 has a thin and long rib shape. In the suspension insulator 1 shown in FIG. 2 does not have the circular hump 13A shown in FIGS. 1*a* and 1*b*.

If the conductive zone 32 is formed as mentioned above, it is possible to further prevent a stress concentration and a concentration of electric stresses to the conductive zone 32, and thus it is a preferred embodiment. Moreover, in an anti-pollution type insulator such as the suspension insulator 1 shown in FIG. 2 having a thin and long rib shape, it is possible to move a position of the dry zone from near the pin fitting to the outer ribs as is clearly understood from the following embodiments. Therefore, it is possible to further improve the effects of the invention such that a wide dry zone can be formed as compared with the suspension insulator 1 shown in FIGS. 1*a* and 1*b*.

Figure 3A:
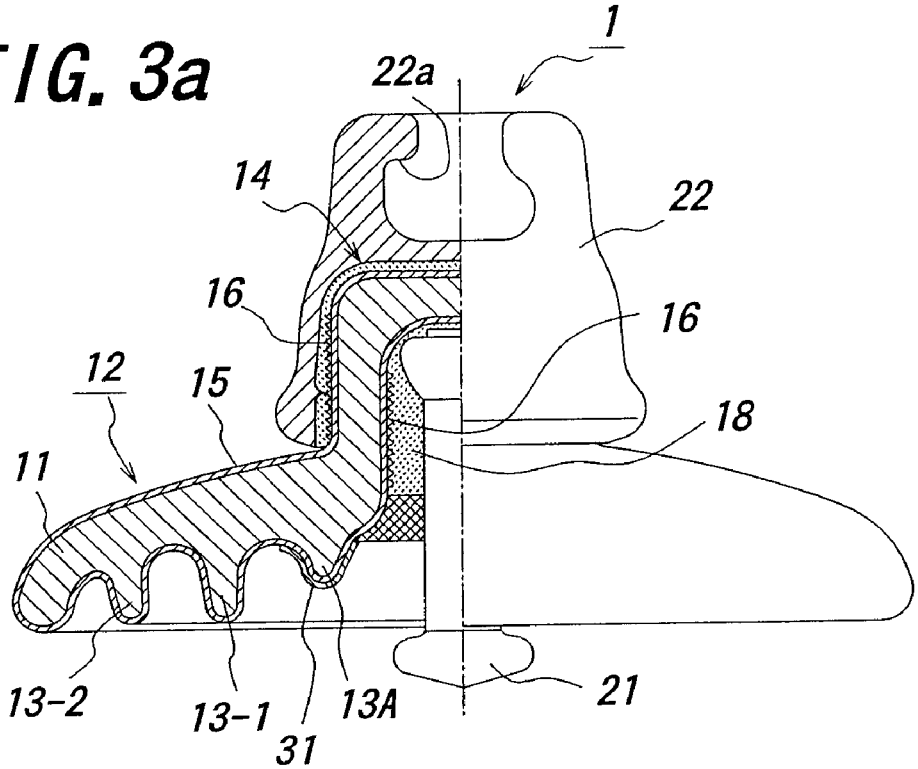
FIGS. 3*a* and 3*b* are schematic views respectively depicting one embodiment of the suspension insulator according to the second aspect of the invention.
Figure 3B:
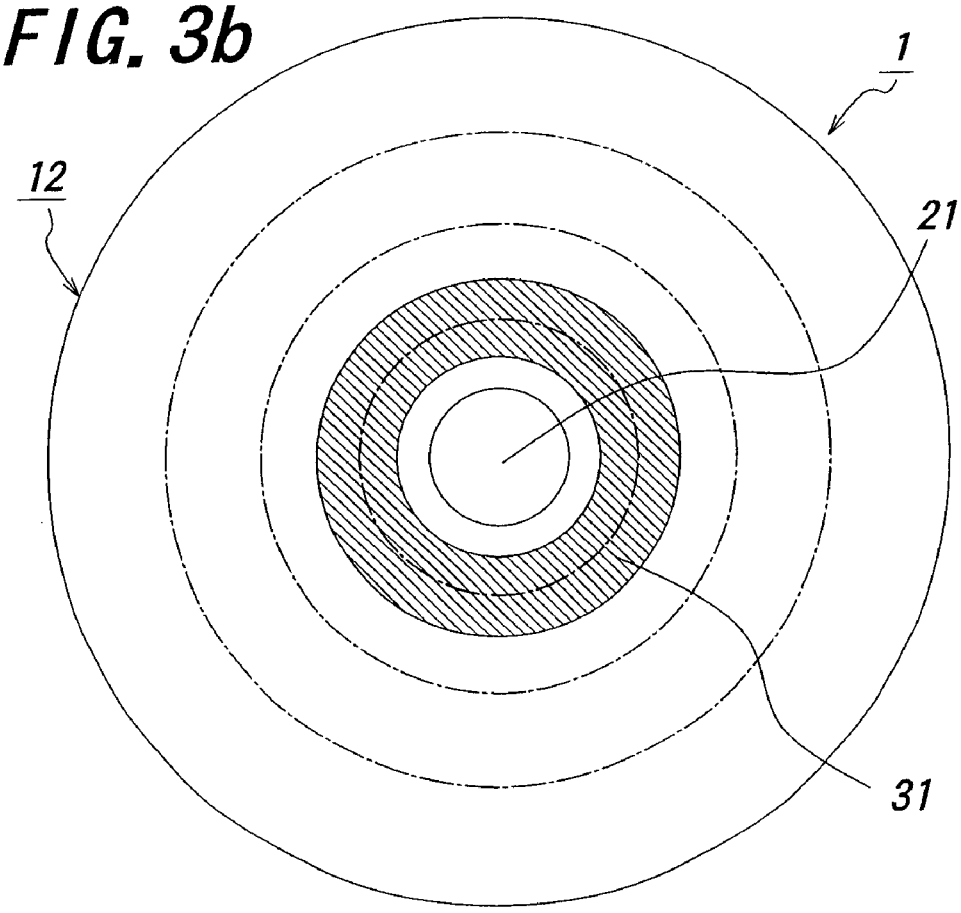

FIGS. 3*a* and 3*b* are schematic views respectively showing one embodiment of a suspension insulator according to the second aspect of the invention. FIG. 3*a* shows a partial cross sectional view that is viewed from a front side, and FIG. 3*b* illustrates a schematic view that is viewed from an under side. In the embodiment shown in FIGS. 3*a* and 3*b*, portions similar to those of FIGS. 1*a* and 1*b* are denoted by the same reference numerals as those of FIGS. 1*a* and 1*b*, and the explanations thereof are omitted here. In the embodiment shown in FIGS. 3*a* and 2*b*, features different from the embodiment shown in FIGS. 1*a* and 1*b* are that only the resistance zone 31 is arranged at a portion between the pin fitting 21 and the inner root portion of the circular rib and the conductive zone 32 is not arranged, i.e. the resistance zone 31 is arranged from the pin fitting 21 and the inner root portion of the first circular rib 13-1 or from the pin fitting 21 and the inner root portion of the second circular rib 13-2. In the embodiment shown in FIGS. 3*a* and 2*b*, the resistance zone 31 is arranged from the pin fitting 21 and the inner root portion of the first circular rib 13-1.

In this case, it is preferred that a surface resistance (1 cm×1 cm ) of the resistance zone 31 is not greater than 4 MΩ. Moreover, as is the same as the second aspect of the invention, it is preferred that a material of the resistance zone 31 is a conductive glaze of ferric oxide series or a conductive glaze of tin oxide series. Further, it is preferred that a resistance zone as is the same as the resistance zone 31 continuing from the cap fitting 22 arranged on the head portion 14 of the suspension insulator 1 is arranged on an upper surface thereof, and a conductive zone is arranged on the upper surface at an outer peripheral portion of the resistance zone.

In the first aspect of the invention and the second aspect of the invention mentioned above, since the resistance zone 31 having a predetermined surface resistance and the circular conductive zone 32 are arranged in the first aspect of the invention, and, since the resistance zone 31 is arranged at a predetermined position in the second aspect of the invention, it is possible to move a zone having a high electric power density, that is apt to be positioned near the pin fitting 21 in the known suspension insulators, toward an outer circular ribs, and thus it is possible to form a stable dry zone with a low electric power. As a result, it is also possible to improve a voltage distribution along the insulator string and thus it is possible to improve pollution withstand voltage characteristics and to prevent a discharge.

Then, in the suspension insulator according to the invention having the construction mentioned above, a theory for improving the pollution withstand voltage and suppressing the discharge is discussed.

Figure 4:
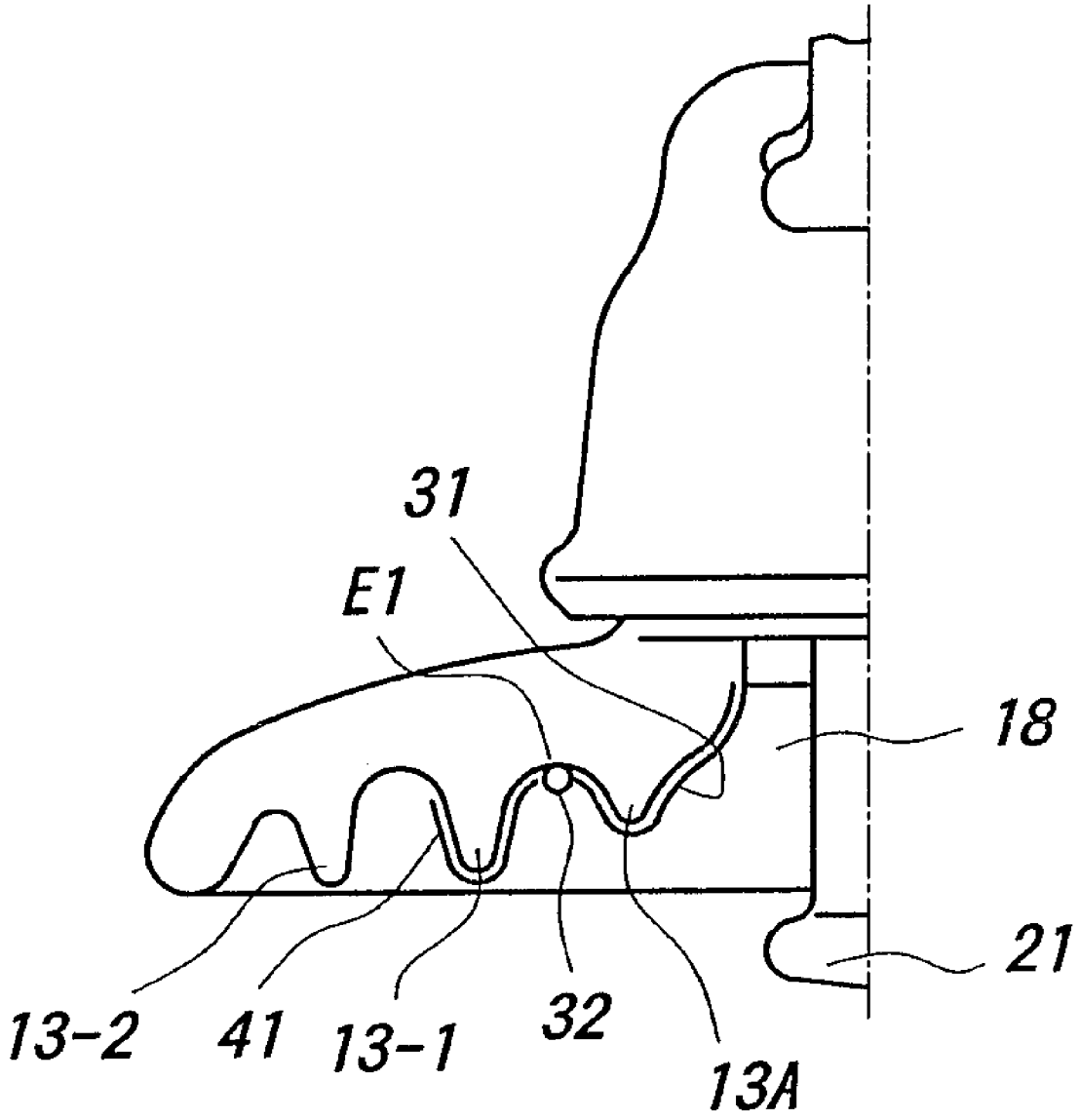
FIG. 4 is a schematic view showing one example of the suspension insulator that is used when a theory for improving the pollution withstand voltage and suppressing the discharge is discussed.

At first, an electric power density distribution with respect to a single suspension insulator is calculated under a condition such that a surface resistance of the pollution zone is constant. As a suspension insulator used for this calculation, use is made of a known suspension insulator (normal one) in which the resistance zone and the circular conductive zone are not arranged with respect to a base suspension insulator having a diameter of 250 mm and a shape shown in FIG. 4, and a suspension insulator according to the invention in which the resistance zone 31 is arranged from the pin fitting 21 to a rib bottom E1 positioned at the inner root portion of the first circular rib 13-1 by using the conductive glaze and the conductive zone 32 is arranged at the rib bottom E1 with respect to the base suspension insulator mentioned above. Calculation conditions are as follows:

(1) A surface resistance (1 cm×1 cm) of the pollution zone : 14.7 MΩ (resistance per single insulator : 10 MΩ);

(2) A surface resistance (1 cm×1 cm) of the conductive glaze : 0.5 MΩ;

(3) The electric power density distribution is calculated from an integrated resistance of the pollution zone and the conductive glaze; and (4) A resistance of the conductive glaze between the pin fitting and the circular conductive zone: about 100 kΩ.

Figure 5:
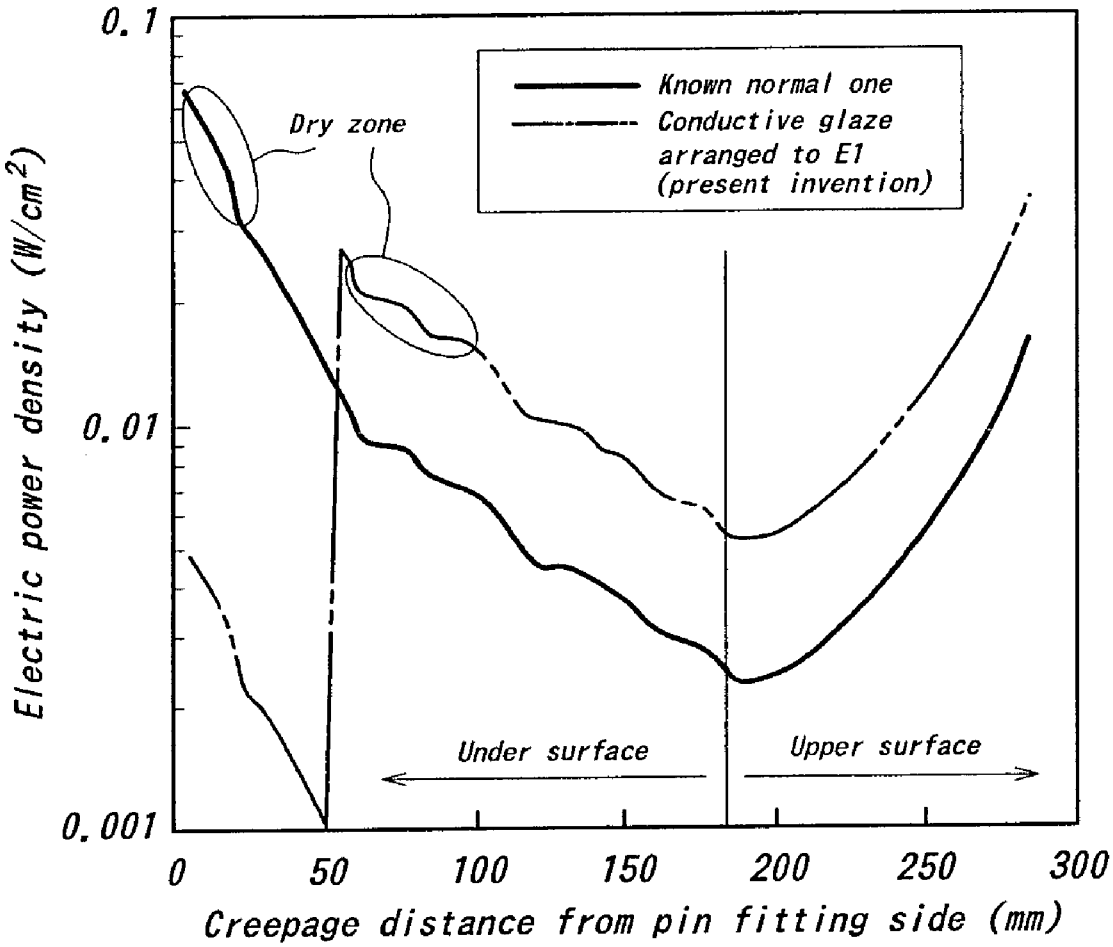
FIG. 5 is a graph illustrating a relation between a creepage distance from the pin fitting side and an electric power density.

The calculation result is shown in FIG. 5 by a relation between a creepage distance from the pin fitting side where a position of the pin fitting is 0 and an electric power density. From the result shown in FIG. 5, it is understood that, in the known normal suspension insulator in which the resistance zone and the circular conductive zone are not arranged, an electric power density is high at a portion around the pin fitting and a dry zone 41 is formed around the pin fitting 21, so that a discharge occurs around the pin fitting 21. On the other hand, it is understood that, in the suspension insulator according to the invention in which the circular conductive zone 32 is arranged at the rib bottom E1 and the conductive glaze is arranged from the pin fitting 21 to the rib bottom E1 as the resistance zone 31, an electric power density is decreased at a portion near the pin fitting 21 and thus a portion of the dry zone 41 is moved outward with respect to the circular conductive zone 32.

Figure 6:
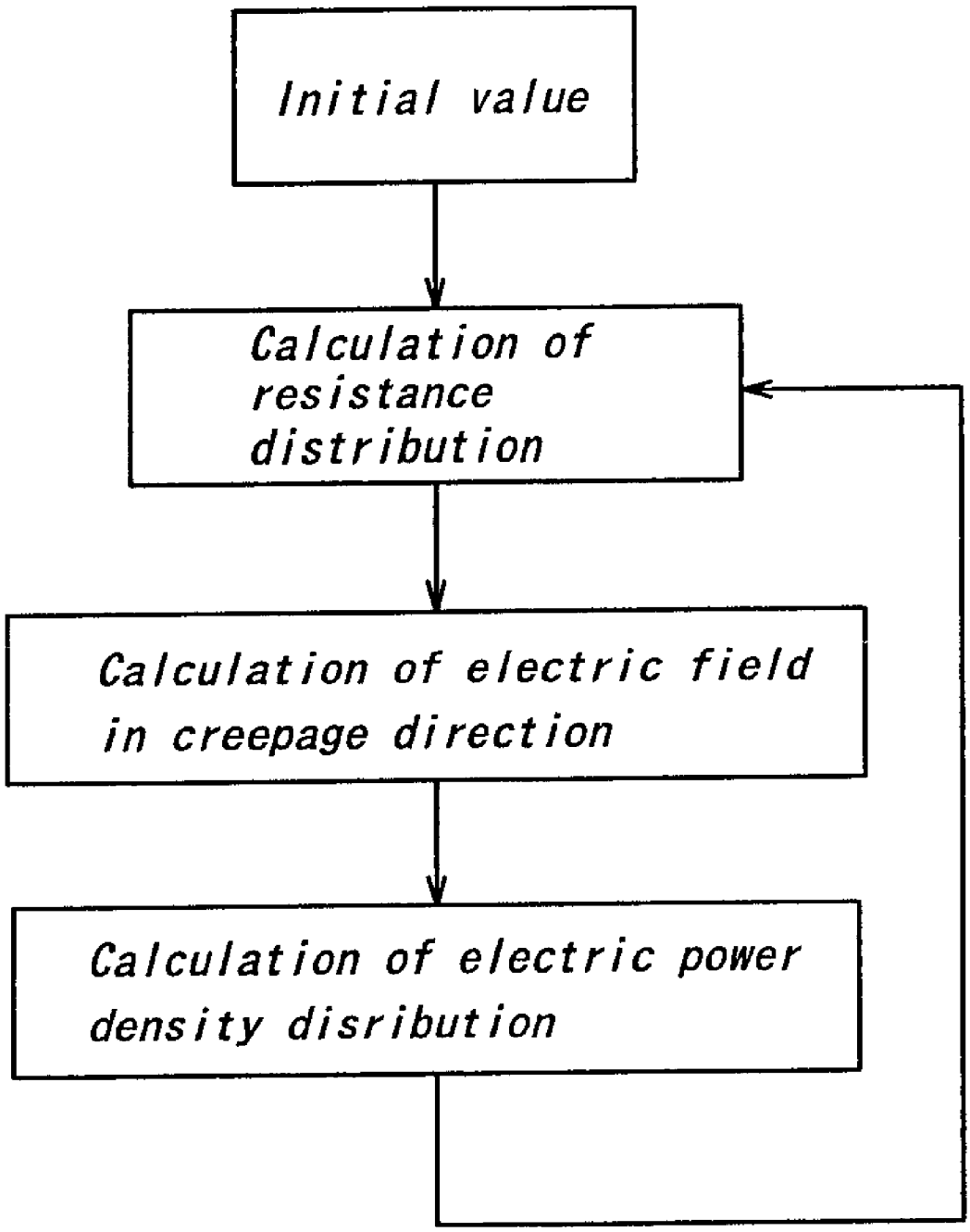
FIG. 6 is a flowchart depicting one example of calculation method that is used when a relation between a position of dry zone (resistance zone) and a maximum electric field is discussed.
Figure 7:
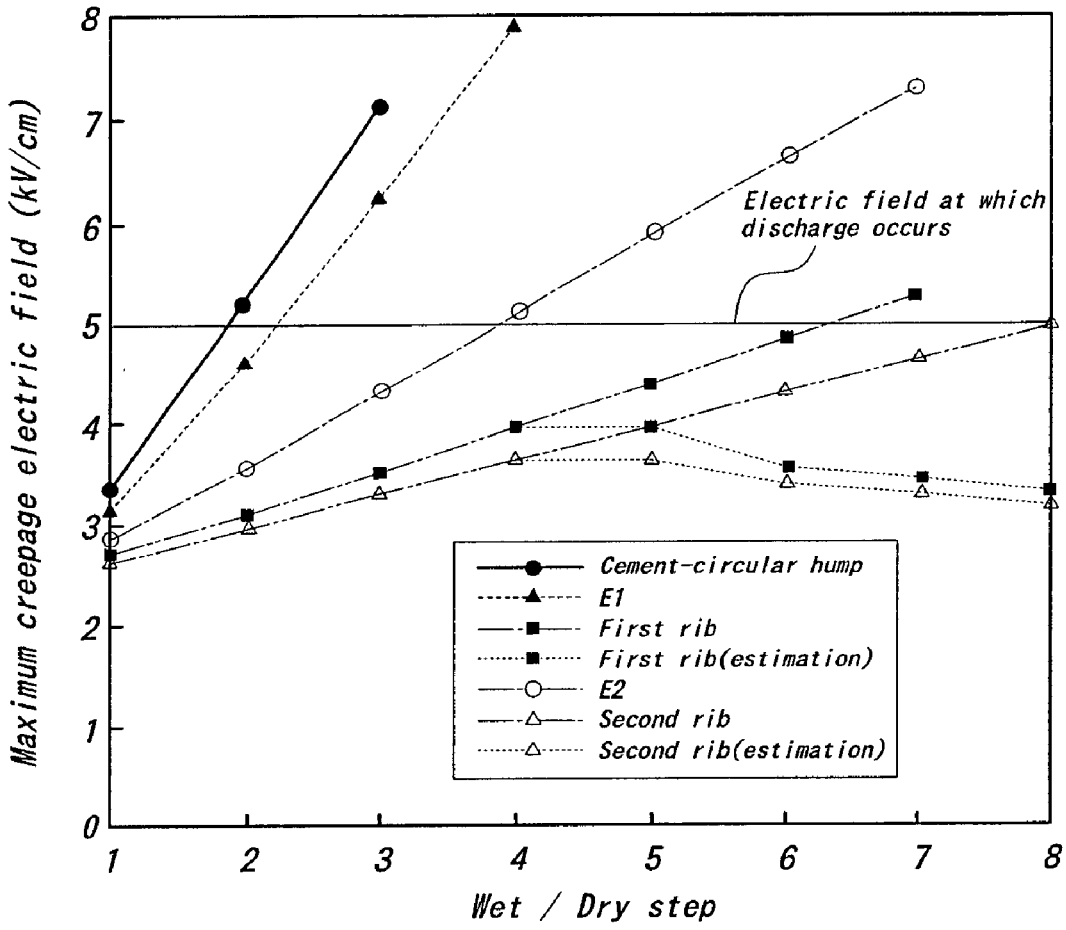
FIG. 7 is a graph showing a relation between the wet/dry step and a maximum creepage electric field.

Then, a relation between a position of the dry zone and a maximum electric field that occur in the suspension insulator is discussed. In the suspension insulator having the construction shown in FIG. 4, it is assumed that the dry zone 41 having a constant width of 40 mm in the creepage direction (radius direction) is formed, at a portion between the cement 18 and the circular hump 13A, at the rib bottom E1 that is positioned at the inner root portion of the first circular rib 13-1, at the first circular rib 13-1, at a rib bottom E2 that is positioned at the inner root portion of the second circular rib 13-2, or at the second circular rib 13-2. Then, maximum creepage electric fields are calculated per the number of repeating the wet/dry steps. Moreover, in the case that the dry zone 41 is arranged at the first circular rib 13-1 and the second circular rib 13-2, a first circular rib (estimation) and a second circular rib (estimation) that are estimated after a step 4, are also calculated. In this case, the reason, such that the estimation values in the case that the dry zone 41 is arranged at the first circular rib and the second circular rib are calculated, is as follows. That is to say, since a porcelain volume of respective circular ribs 13-1 and 13-2 is small, a temperature of the overall circular rib is increased at constant. Therefore, an effect of reducing an electric field is expected because the overall rib is dried up. The calculation is performed according to a calculation flowchart shown in FIG. 6 under a condition such that a surface resistance of the pollution zone is a constant conductivity at an initial value and is in proportion to the electric power density after the next step. The result of the calculation is shown in FIG. 7. In FIG. 7, as an electric field at which a discharge occurs, use is made of a value of 5 kV/cm since this value is known in this technical field.

From the result shown in FIG. 7, the followings are understood:

An increase of the maximum electric field is rapid in the case of a normal state in which a portion near the cement of the pin fitting side is dried;

An increase of the maximum electric field becomes slow when the dry zone is formed outward with respect to the pin fitting; and An increase of the electric field becomes particularly slow in the case that the dry zone is formed at the rib. It is supposed that, since a radius difference between an inner surface and an outer surface is small at the rib portion and since a porcelain volume of the circular rib is small, a temperature of the rib is increased before reaching to the electric field at which a discharge occurs, and thus it is possible to prevent such a discharge.

Figure 8C:
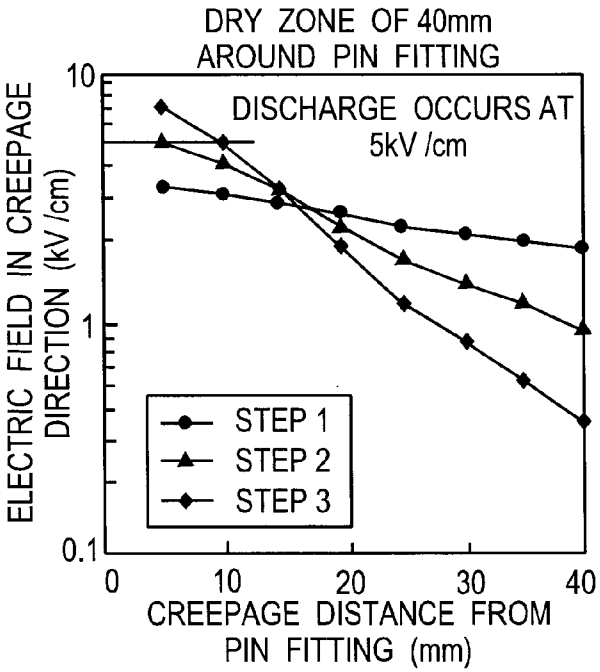
FIGS. 8A-8C are schematic views illustrating a relation between the creepage distance from the pin fitting side and an electric field in a creepage direction.
Figure 8B:
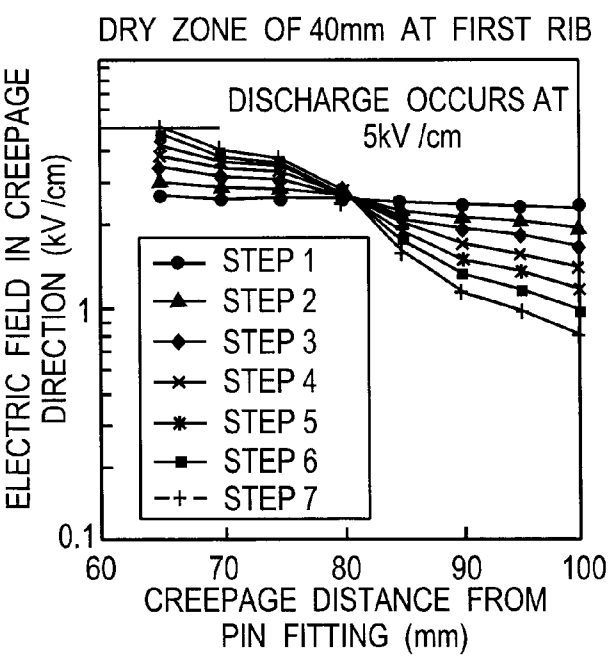
Figure 8A:
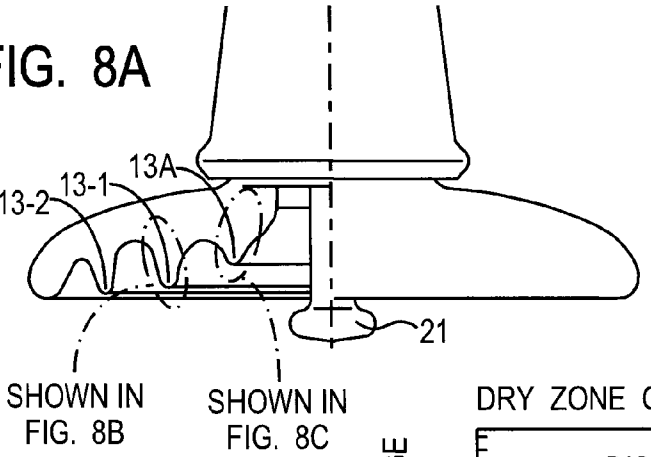
Figure 9:
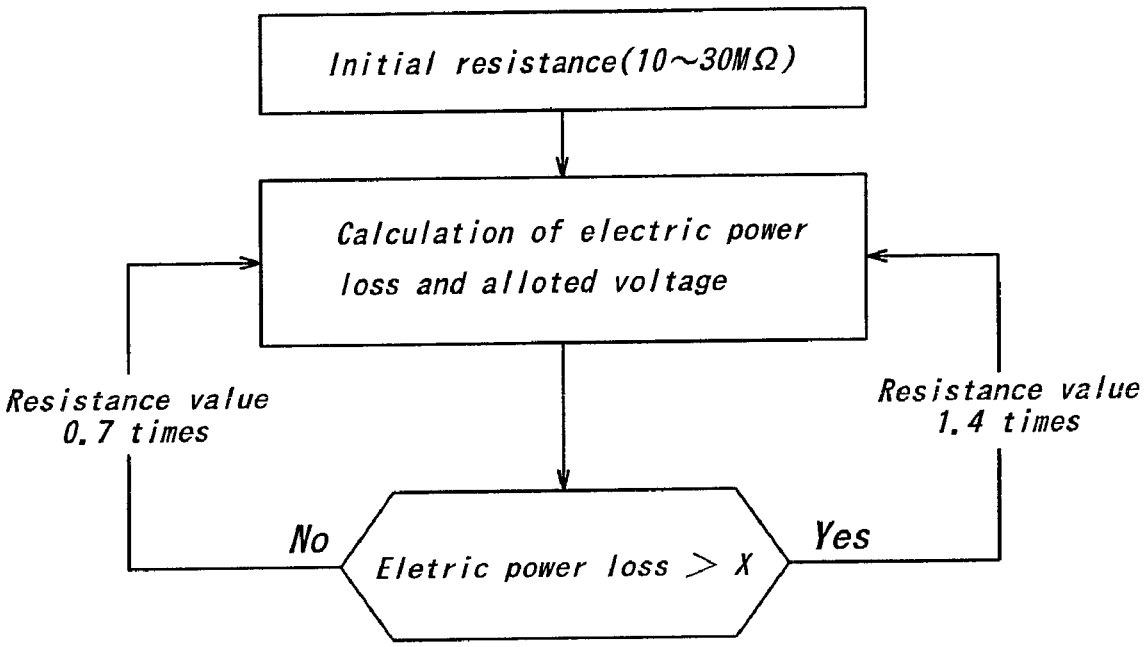
FIG. 9 is a flowchart depicting one example of a calculation method for a voltage distribution along the insulator string.

Then, a relation between a forming position of the dry zone 41 and a variation of electric field is summarized on the basis of the calculation result shown in FIG. 7 and is compared. That is to say, from the result shown in FIG. 7, a relation between a creepage distance from the pin fitting 21 and an electric field in a creepage direction is obtained for respective steps with respect to the suspension insulator in which the dry zone 41 of 40 mm is arranged at the first circular rib 13-1 and the suspension insulator in which the dry zone 41 is arranged around the pin fitting 21 i.e. at a portion between the cement and the circular hump 13A. The result is shown in FIG. 8A. In the case that the dry zone 41 of 40 mm is arranged at the first circular rib 13-1, a radius of the inner root portion of the first circular rib 13-1 is 62.1 mm and a radius of a position 40 mm outward (in a creepage direction) from the inner root portion is 74.9 mm. Therefore, a radius ratio between an inner portion and an outer portion is 1.21 (FIG. 8C). On the other hand, in the case that the dry zone 41 of 40 mm is arranged around the pin fitting 21, a radius of the cement portion is 23.4 mm and a radius of a position 40 mm outward (in a creepage direction) from the cement portion is 45.3 mm (FIG.8B). Therefore, a radius ratio between an inner portion and an outer portion is 1.94.

Then, characteristics of the insulator string in which a number of suspension insulators are connected in series are investigated. As a factor determines voltage distribution, there is an easily drying property of the dry zone. Allotted voltage in the insulator string is highest at a power supply end and becomes smaller at a center portion. These allotted voltages at the power supply end and at the center portion are different by about 3 times. In order to simulate this situation easily, it is assumed that an initial resistance of the single suspension insulator is varied in a range of 10 –30 MΩ equidistantly. If a wet/dry operation proceeds by one step from this initial state, it is assumed that the resistance of respective insulators is decreased by 0.7 times. Since a current flowing through the insulator string is increased, power losses of some insulators with high allotted voltage may become greater than the predetermined value. In this case, resistance values of these insulators are increased 1.4 times. The assumptions for calculation are as follows:

(1) 200 kV is applied to the insulator string having 20 insulators in series;

(2) In order to calculate easily, a calculation is performed under an assumption such that a resistance of the insulator is not varied in accordance with a temperature variation; and (3) Since an impedance of the insulator does not become greater than 50MΩ due to a capacitance of the insulator, an upper limit of the resistance value is set by arranging a resistor of 50 MΩ in parallel.

Figure 10:
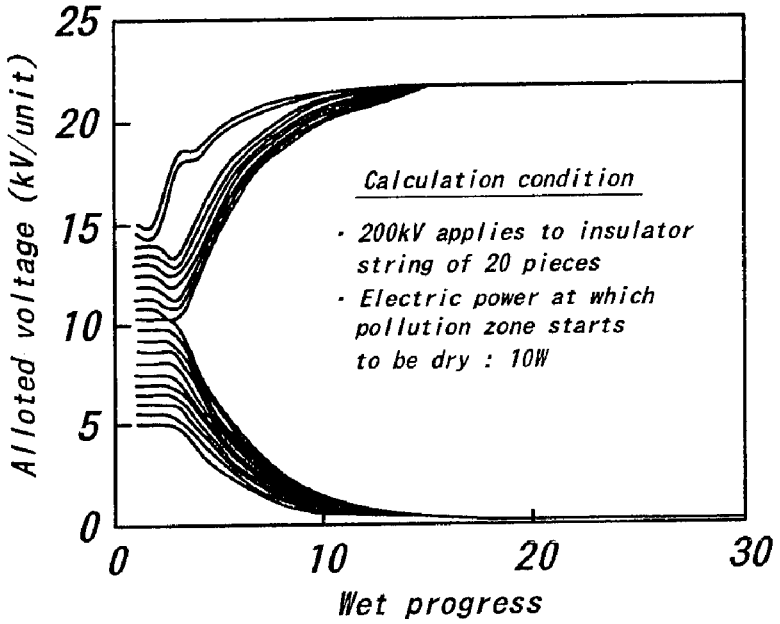
FIG. 10 is a graph showing a relation between a wet progress and the allotted voltage.
Figure 11:
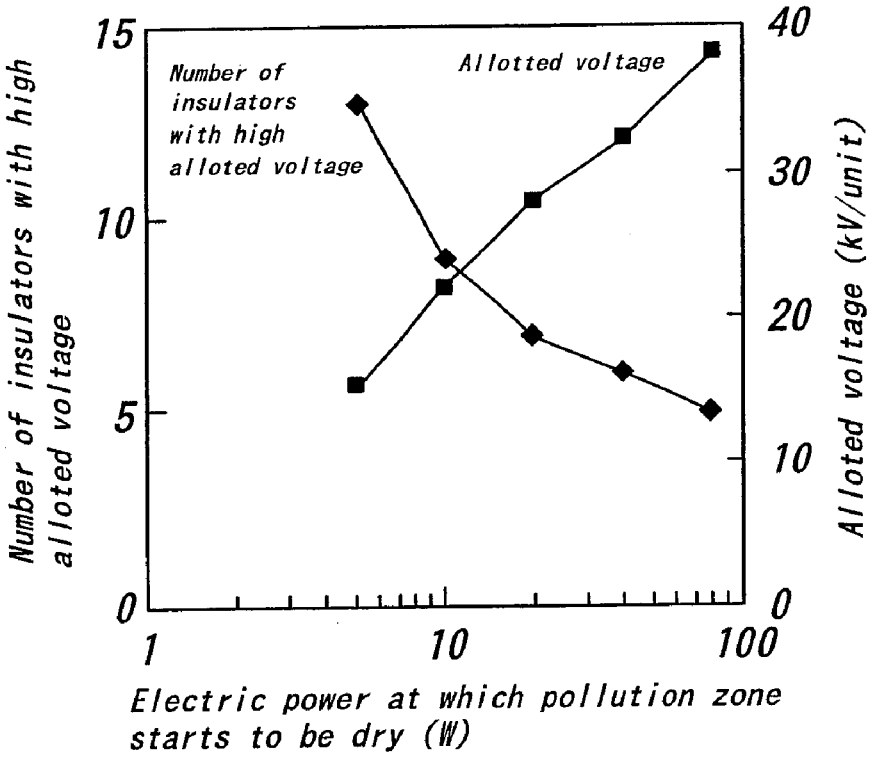
FIG. 11 is a graph illustrating a relation between an electric power at which the pollution zone starts to be dry and the number of insulators with high allotted voltage or allotted voltage.

A calculation result of a relation between a wet progress and a allotted voltage is shown in FIG. 10, and a calculation result of a relation between an electric power at which the pollution zone starts to be dry and the number of insulators with high allotted voltage is shown in FIG. 11. The wet progress in FIG. 10 shows a numerical value corresponding to a time progress. From the result shown in FIG. 10, it is understood that, in an initial state, a voltage load difference is 3 times, but, according to a wet progress, some insulators show high allotted voltage and other insulators show very low allotted voltage. From the result shown in FIG. 11, it is understood that, if the electric power at which the pollution zone starts to be dry becomes lower, the number of the insulators with high allotted voltage is increased and the maximum allotted voltage becomes low. Therefore, it is understood that, the insulator, which can be dried up with a low electric power, shows an excellent voltage distribution along an insulator string.

Figure 12A:
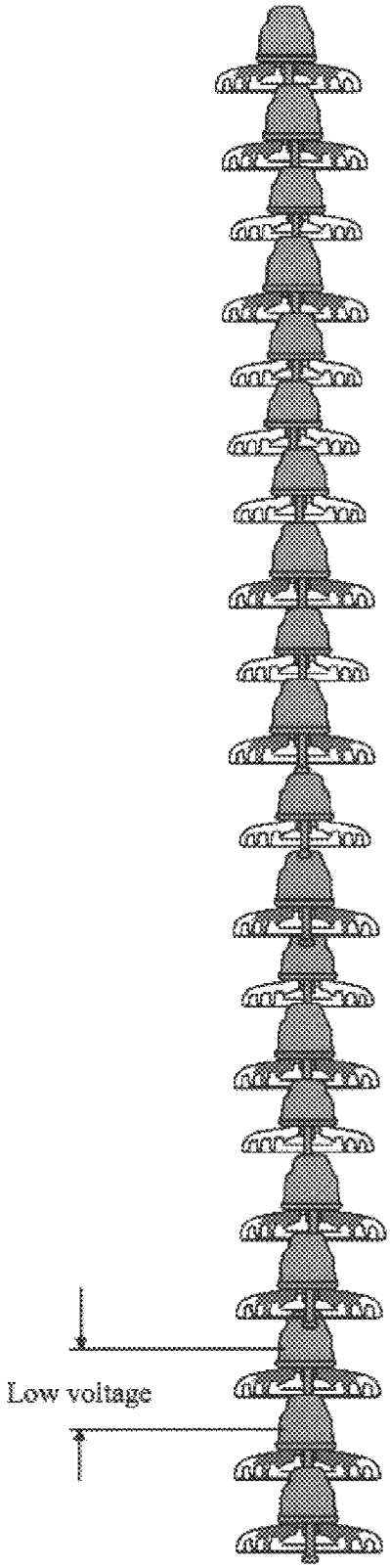
FIGS. 12*a* and 12*b* are schematic views respectively depicting a drying state during the pollution test in the case that the insulator string is constructed by the suspension insulators according to the invention (FIG. 12*a*) and by the known suspension insulator (FIG. 12*b*)
Figure 12B:
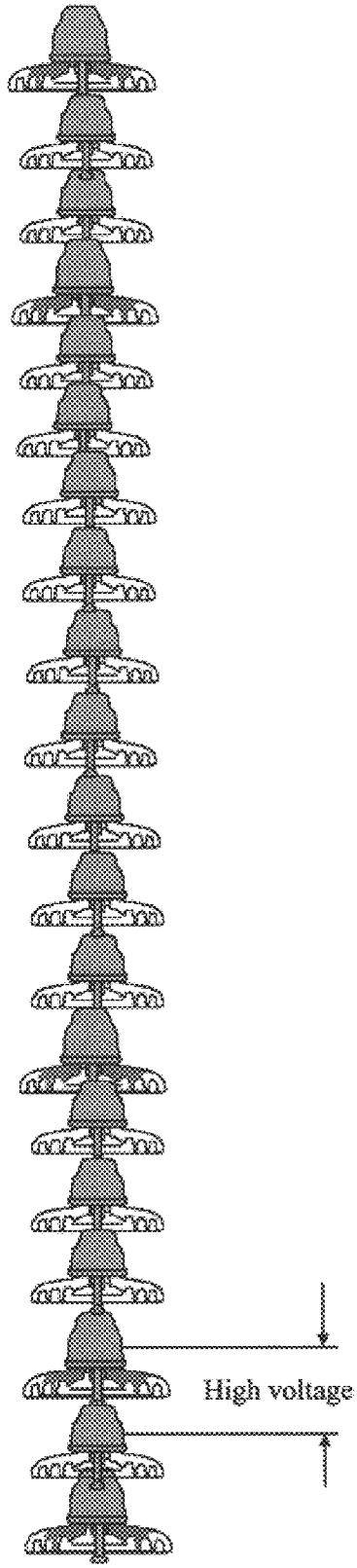

Then, by performing a pollution test for the insulator string having 20 insulators in series, a drying condition of the suspension insulator is investigated with respect to the suspension insulator according to the invention in which the circular conductive zone and the resistance zone are arranged and the known suspension insulator in which the circular conductive zone and the resistance zone are not arranged. The results are shown in FIGS. 12*a* and 12*b*. FIG. 12*a* shows a drying condition of the suspension insulator according to the invention, and FIG. 12*b* illustrates a drying condition of the known suspension insulator. In FIGS. 12*a* and 12*b*, a portion colored by red shows a drying state. From the result shown in FIG. 12*a*, it is understood that, in the insulator string using the suspension insulator according to the invention, 12 suspension insulators among 20 show a drying state at near the second rib, and a ratio of the dried up suspension insulator is 60%. On the other hand, from the result shown in FIG. 12*b*, it is understood that, in the insulator string using the known suspension insulators, 5 suspension insulators among 20 show a drying state at a portion between the pin fitting and the rib bottom E1, and a ratio of the dried up suspension insulator is 25%.

From the results mentioned above, the followings are understood:

(1) Since a radius difference between an inner portion and an outer portion is small at the rib portion, an electric field distribution in a creepage direction becomes relatively constant, and thus it is possible to suppress a discharge occurrence;

(2) Since a porcelain volume of the rib portion is small, a dry zone can be formed by a low electric power, and thus it is possible to improve a voltage distribution along a string; and (3) From the results mentioned in (1) and (2), a pollution withstand voltage is improved, and thus it is possible to obtain a suspension insulator which can suppress a discharge.

Hereinafter, actual experiments will be explained.

Experiment 1 (as to positions of circular conductive zone and resistance zone)

Figure 13:
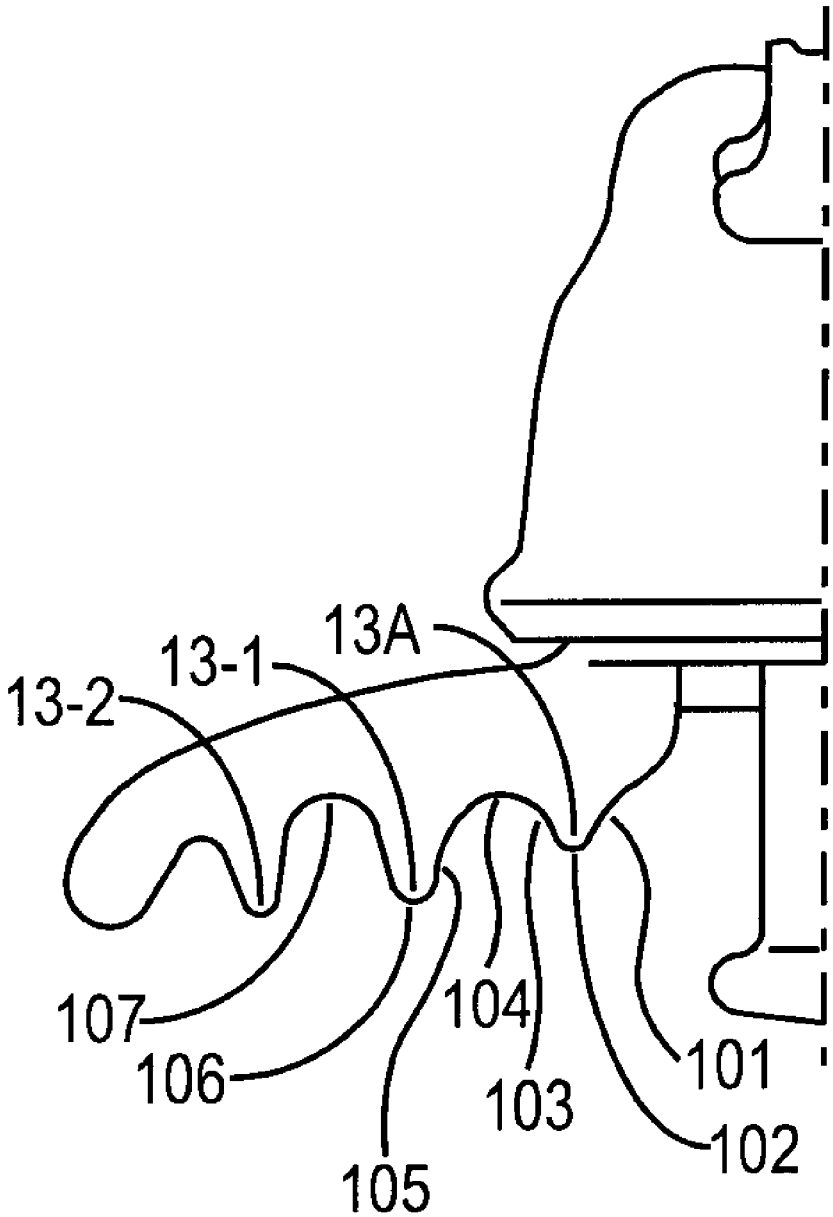
FIG. 13 is a schematic view showing an end position of the resistance zone when it is discussed.

In order to obtain a preferred embodiment about the positions of the circular conductive zone and the resistance zone, a suspension insulator was prepared, in which the circular conductive zone (electrode) was arranged at a position among positions 101-107 shown in FIG. 13 and the resistance zone was arranged from the pin fitting to the one of the positions 101-107 mentioned above. The thus prepared suspension insulators were connected with each other in five series to obtain the insulator string. Then, with respect to the thus obtained insulator string, clean fog tests based on JEC-0201 "AC Voltage Insulation Tests" defined as a standard of the Japanese Electrotechnical Committee were performed 5 under a condition such as a salt deposit density of 0.25 mg/cm$^2$ and a test voltage of 55 kV so as to investigate and estimate discharge condition.

The results are shown in the following Table 1.

TABLE 1

| Discharge condition/ electrode position | 101 D1 −7 mm | 102 D1 top | 103 D1 +7 mm | 104 E1 bottom | 105 D2 −20 mm | 106 D1 top | 107 E2 bottom |
|---|---|---|---|---|---|---|---|
| ○: No discharge | once | once | once | 2 times | 3 times | once | 2 times |
| ▲: Stable after discharge | 0 | once | once | once | once | 0 | 0 |
| x: Greater number discharge | 2 times | 2 times | once | once | 0 | 2 times | 2 times |
| Estimation | | | | 2 | 1 | | 3 |

From the results shown in Table 1, it was understood that, the 10 suspension insulator, in which the circular conductive zone (electrode) was arranged at near the rib bottom E1 positioned at the inner root portion of the first circular rib 13-1 and the resistance zone was arranged from the pin fitting to the rib bottom E1, was most effective. Moreover, it was understood that, the suspension insulator, in which the circular conductive zone was arranged at the rib bottom E2 between the first circular rib 13-1 and the second circular rib 13-2, was effective. Further, it was understood that, the suspension insulator, in which the circular conductive zone was arranged at respective ribs, was improved as compared with the known suspension insulator having no conductive zone and resistance zone.

Experiment 2 (as to resistance value of resistance zone)

In order to obtain a most preferred zone of a resistance value of the resistance zone, the known suspension insulator in which the circular conductive zone and the resistance zone were not arranged, the comparative suspension insulator in which the circular conductive zone was arranged at the rib bottom E1 positioned at the inner root portion of the first circular rib 13-1 and the circular conductive zone was electrically connected to the pin fitting, and the suspension insulator according to the invention in which the circular conductive zone was arranged at the rib bottom E1 positioned at the inner root portion of the first circular rib 13-1 and the resistance zone having a predetermined surface resistance (1 cm×1 cm) was arranged at a portion between the pin fitting and the rib bottom El, were prepared respectively.

Then, the thus prepared suspension insulators were connected in series in such a manner that 7 units were connected in the known suspension insulator and 5 units were connected both in the comparative suspension insulator and the suspension insulator according to the invention to obtain the insulator strings. Then, with respect to the thus obtained insulator strings, clean fog tests were performed in the same manner as that of experiment 1 under a condition such that a salt deposit density of 0.25 mg/cm$^2$ and a test voltage of 55 kV so as to investigate and estimate discharge occurrence and withstand voltages. The result of the known suspension insulator is shown in the following Table 2, and the results of the comparative suspension insulator and the suspension insulator according to the invention are shown in the following Table 3. In Table 2 and Table 3, the discharge occurrence is shown in such a manner that, when the discharge occurs 2 times among 5 times trials, an indication is 2/5, and the withstand voltage is shown in such a manner that, when 7 times endure among 8 times trials, an indication is 7/8.

TABLE 2

| Known suspension insulator | |
|---|---|
| Always intermittent discharge occurrence | 4/4 |
| Number of voltage withstand | 4/4 |

TABLE 3

| Suspension insulators according to the invention and comparative example | Circular conductive zone : rib bottom positioned at inner root portion of first circular rib | | | |
|---|---|---|---|---|
| | Short between pin and conductive zone (comparative example) | Resistance zone : between pin and conductive zone | | |
| | | 0.5 MΩ | 4.0 MΩ | 20 MΩ |
| Number of discharge occurrence (excluding a single discharge) | 0/9 | 0/8 | 2/5 | 2/2 |
| Number of voltage withstand | 8/9 | 7/8 | 5/5 | 0/2 |

From the results shown in Table 2 and Table 3, it was understood that a surface resistance (1 cm×1 cm) should be not greater than 4 MΩ in the present invention. Moreover, from the results of the clean fog tests, it was understood that the comparative suspension insulator, in which the circular conductive zone was electrically connected to the pin fitting, was effective. However, in cold switch on condition in which AC voltage is suddenly applied under polluted and wet condition or in condition in which sea water is sprayed, it is necessary to use a creepage distance between the circular conductive zone and the pin fitting. In the polluted and wet condition, a resistance between the circular conductive zone and the pin fitting becomes a few kΩ—a few 10 kΩ. In the suspension insulator according to the invention, the resistance between the circular conductive zone and the pin fitting can be higher resistance such as 50 kΩ–MΩ, and thus it is possible to use a creepage distance at this portion effectively.

In the embodiments mentioned above, the explanations are made to the suspension insulator in which the circular conductive zone and the resistance zone are arranged on the under surface. However, the same effects as is the same as the embodiments mentioned above can be obtained, if only the resistance zone having a surface resistance of not greater than 4 MΩ is arranged on the under surface, and further if the resistance zone as is the same as the resistance zone i.e. the resistance zone having a surface resistance (1 cm×1 cm) arranged on the under surface at an inner portion continuing from the cap fitting arranged on the head portion of the suspension insulator is arranged on an upper surface thereof, and the conductive zone as is the same as the conductive zone arranged on the under surface is arranged on the upper surface at an outer peripheral portion of the resistance zone.

Experiment 3 (as to effect of rib shape)

In order to investigate an effect of a rib shape, the suspension insulator (CA-845) having a normal rib shape shown in FIGS. 1*a* and 1*b* and the suspension insulator (CA-894) having a thin and long rib shape shown in FIG. 2 were prepared. Shed shape parameters of respective suspension insulators are shown in the following Table 4. In addition, with respect to the respective suspension insulators, a normal suspension insulators in which the circular conductive zone and the resistance zone are not arranged and the suspension insulator according to the invention in which the circular conductive zone is arranged at the rib bottom positioned at the inner root portion of the first circular rib 13-1 and the resistance zone having a predetermined surface resistance is arranged at a portion between the pin fitting and the rib bottom, were prepared. In the calculation of CA-894, since the circular hump 13A is calculated as the first circular rib, but the situation is substantially same as that of CA-845.

With respect to the thus prepared suspension insulators, a pollution withstand voltage (kV/unit) was measured according to the clean fog test, when a salt deposit density (=SDD, mg/cm$^2$) is 0.25 or 1.0 and the non-soluble material deposit density (=NSDD, mg/cm$^2$) is 0.1 or 0.2 respectively. The pollution withstand voltage was measured by measuring an overall pollution withstand voltage of the insulator string using the thus prepared suspension insulators according to the invention connected 5 units with each other in series, and calculating an average value per one unit from the thus measured overall pollution withstand voltage value. The result is shown in the following Table 5.

TABLE 4

| Shed shape parameters of insulator | CA-845 | CA-894 |
|---|---|---|
| Shed diameter, mm | 320 | 320 |
| Creepage distance, mm | 550 | 550 |
| rib shape at pin side | | |
| Target rib | Second rib | First rib |
| Diameter, mm | 142 | 132 |
| Length, mm | 24 | 35 |
| Thickness, mm | 8 | 6 |
| Diameter of circular electrode (connected electrically to pin) | ϕ120 | ϕ110 |

TABLE 5

| Salt deposition density mg/cm$^2$ | Non-soluble substance deposition density mg/cm$^2$ | CA-894 | | CA-845 | |
|---|---|---|---|---|---|
| | | Normal insulator | Insulator of invention | Normal insulator | Insulator of invention |
| 0.25 | 0.1 | 17 | 26 | 16 | 17 |
| 1.0 | 0.2 | 9 | 14 | 10 | 11 |

From the result shown in Table 5, it was understood that CA-894 having a thin and long rib shape can improve the pollution withstand voltage effectively as compared with CA-845 having a normal rib shape. Moreover, even in the CA-845 having a normal rib shape, the effects of the invention were detected slightly. Both in CA-894 and CA-845, it was understood that the discharge occurrence of the suspension insulator according to the invention was very small as compared with the normal suspension insulator.

Experiment 4 (as to dry zone)

Figure 14:
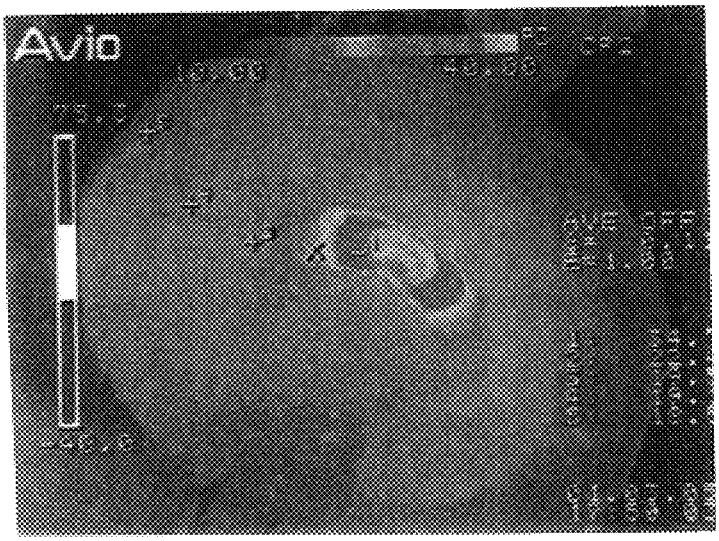
FIG. 14 is a schematic view illustrating a surface temperature distribution of the known suspension insulator in which the circular conductive zone and the dry zone (resistance zone) are not arranged.
Figure 15:
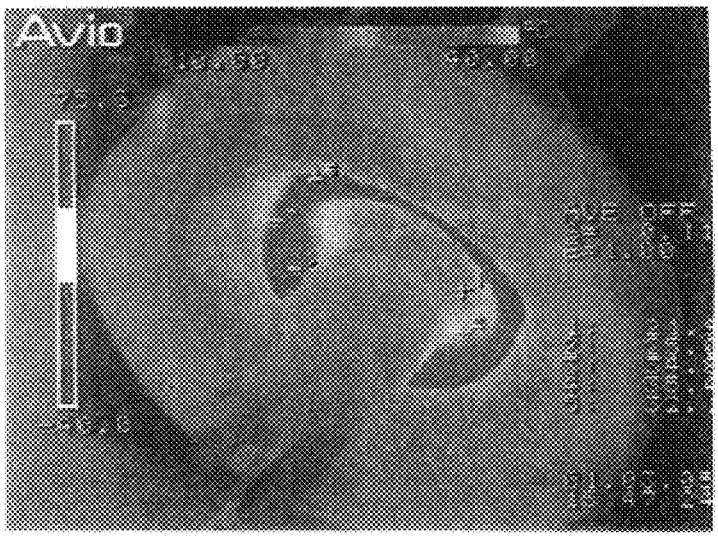
FIG. 15 is a schematic view depicting a surface temperature distribution of the suspension insulator according to the invention in which the circular conductive zone and the dry zone (resistance zone) are arranged.

In order to investigate a state of the dry zone according to the invention, with respect to the suspension insulator according to the invention having a thin and long rib shape in which the circular conductive zone and the resistance zone were arranged as shown in FIG. 2 and the suspension insulator with same shed profile in which the circular conductive zone and the resistance zone were not arranged, a surface temperature distribution at a pollution wet state was measured according to the clean fog test. A surface temperature distribution of the normal suspension insulator is shown in FIG. 14, and a surface temperature distribution of the suspension insulator according to the invention is shown in FIG. 15. If the results of FIGS. 14 and 15 were compared, it was understood that the dry zone having a short width was formed at a portion near the pin in the normal suspension insulator, and, on the other hand, a temperature of the rib was increased gradually in a constant manner and a width of the dry zone was widened in the suspension insulator according to the invention.

As mentioned above in detail, according to the invention, since the resistance zone having a predetermined resistance and the conductive zone are arranged in the first aspect of the invention, or, since the resistance zone is arranged at a predetermined position in the second aspect of the invention, a position to which a high electric power is concentrated can be moved outward with respect to the center of insulator, and thus it is possible to form a stable dry zone with a low electric power. As a result, it is also possible to improve a voltage distribution along the insulator string and thus it is possible to improve pollution withstand voltage characteristics and to prevent a discharge.

What is claimed is:

1. A suspension insulator comprising:

a shed including a top surface and a bottom surface;

a pin fitting located at a center portion of the shed and projecting from the bottom surface;

a plurality of circular ribs located concentrically around the pin fitting;

a first circular resistance zone having a surface resistance (1 cm×1 cm) of not greater than 4MΩ and located on the bottom surface at an inner portion extending radially outwardly from the pin fitting; and a first conductive zone located on the bottom surface radially outward of the first resistance zone.

2. The suspension insulator according to claim 1, wherein the first conductive zone has less surface resistance than the first resistance zone.

3. The suspension insulator according to claim 1, wherein the first resistance zone is located at a portion radially extending from the pin fitting to a base portion of one of the plurality of circular ribs.

4. The suspension insulator according to claim 1, wherein a material of the first resistance zone comprises a conductive glaze of ferric oxide series or a conductive glaze of tin oxide series.

5. The suspension insulator according to claim 1, wherein a material of the first conductive zone comprises a material selected from the group of materials consisting of a metal, a conductive glaze of ferric oxide series having a low resistance and a conductive glaze of tin oxide series having a low resistance, and a thickness of the glaze of the first conductive zone is larger than that of the glaze of the first resistance zone.

6. The suspension insulator according to claim 5, wherein the first conductive zone comprising a recess in the bottom surface of the shed, the recess filled with a conductive material selected from the group consisting of ferric oxide series conductive glazes and tin oxide series conductive glazes, said first conductive zone having a thickness larger than that of the first resistance zone.

7. The suspension insulator according to claim 1, further comprising:

a second circular resistance zone, the same as the first resistance zone, and a second circular conductive zone, the same as the first conductive zone, said second resistance zone and said second conductive zone located on said top surface, the second conductive zone being radially outward of the second resistance zone.

8. A suspension insulator comprising:

a shed including an top surface and a bottom surface;

a pin fitting located at a center portion of the shed and projecting from the bottom surface;

a plurality of circular ribs located concentrically around the pin fitting; and a circular first resistance zone located on the bottom surface at an inner portion extending radially outwardly from the pin fitting and between the pin fitting and a base portion of one of the plurality of circular ribs.

9. The suspension insulator according to claim 8, wherein the first resistance zone has a surface resistance (1 cm×1 cm) of not greater than 4MΩ.

10. The suspension insulator according to claim 8, wherein a material of the first resistance zone is selected from the group consisting of a conductive glaze of ferric oxide series and a conductive glaze of tin oxide series.

11. The suspension insulator according to claim 8, further comprising a second circular resistance zone, the same as the first resistance zone, and a circular conductive zone, said second resistance zone and said conductive zone located on the top surface, the conductive zone being radially outward of the second resistance zone.

* * * * *